United States Patent [19]

Williams

[11] Patent Number: 4,733,550

[45] Date of Patent: Mar. 29, 1988

[54] APPARATUS FOR FORMING A DOMED BOTTOM IN A CAN BODY

[75] Inventor: Arthur E. Williams, Greenbrier, Tenn.

[73] Assignee: Precision Products of Tennessee, Inc., Springfield, Tenn.

[21] Appl. No.: 17,059

[22] Filed: Feb. 20, 1987

Related U.S. Application Data

[63] Continuation-in-part of Ser. No. 823,553, Jan. 29, 1986, abandoned.

[51] Int. Cl.[4] ..... B21D 22/00

[52] U.S. Cl. ..... 72/348; 72/466

[58] Field of Search ..... 72/350–354, 72/347–349, 465, 466

[56] References Cited

U.S. PATENT DOCUMENTS

| | | | |
|---|---|---|---|
| 3,425,257 | 2/1969 | Heiser | 72/350 |
| 3,540,259 | 11/1970 | Hinshaw | 72/465 |
| 3,768,295 | 10/1973 | Cudzik | 72/347 |
| 3,771,345 | 11/1973 | Paramonoff | 72/349 |
| 4,109,502 | 8/1978 | Schaffer | 72/349 |
| 4,173,883 | 11/1979 | Boik | 72/348 |
| 4,179,909 | 12/1979 | Maeder | 72/349 |
| 4,183,237 | 1/1980 | Schaffer | 72/349 |
| 4,289,014 | 9/1981 | Maeder et al. | 72/348 |
| 4,372,143 | 2/1983 | Elert et al. | 72/347 |
| 4,620,434 | 11/1986 | Pulciano et al. | 72/349 |

*Primary Examiner*—Lowell A. Larson

*Attorney, Agent, or Firm*—Harrington A. Lackey

[57] ABSTRACT

An apparatus for forming a dome in the bottom wall of a can body having a beveled peripheral edge incorporating a floating doming die and pressure ring to compensate for misalignment of the doming die and punch or the can body, and resilient members for restoring the doming die and pressure ring accurately to a normal coaxial central position.

9 Claims, 4 Drawing Figures

Fig. 1.
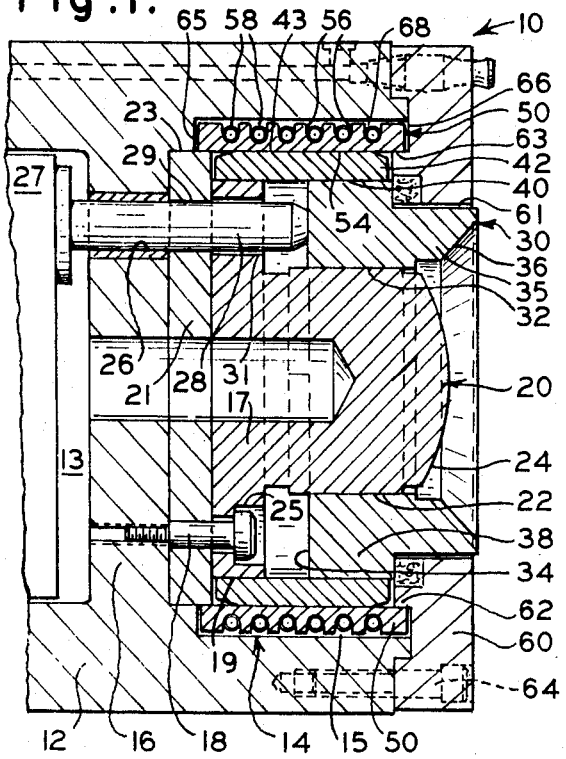
Fig. 3.
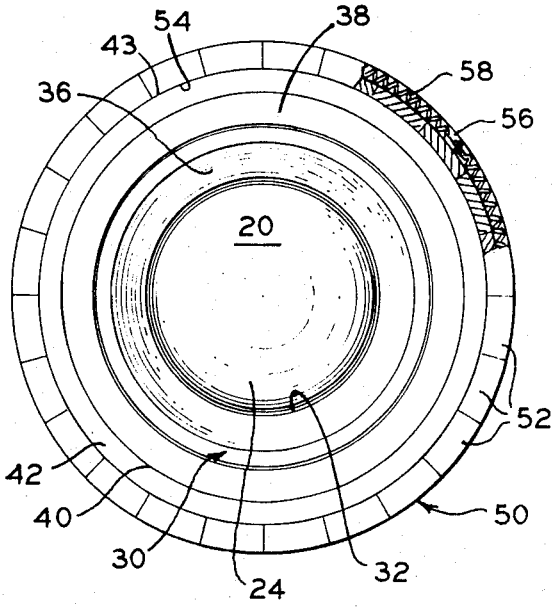
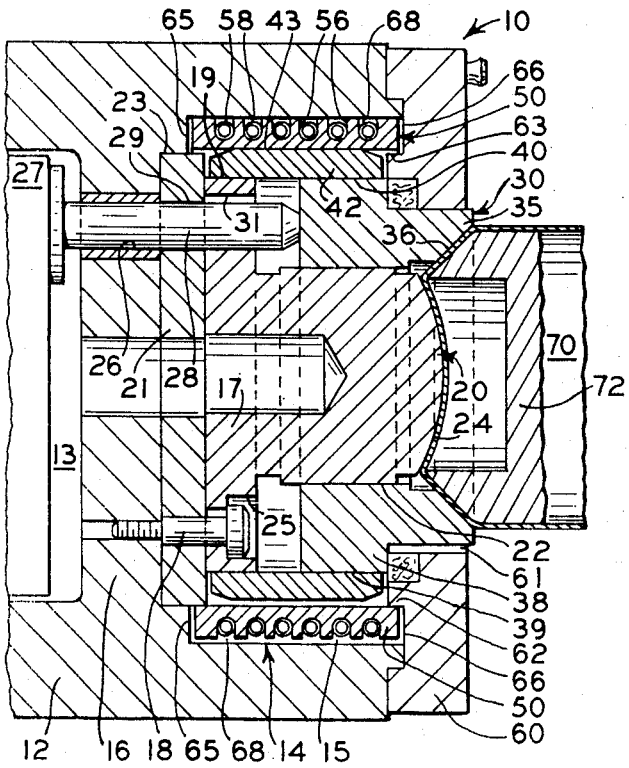
Fig. 2.
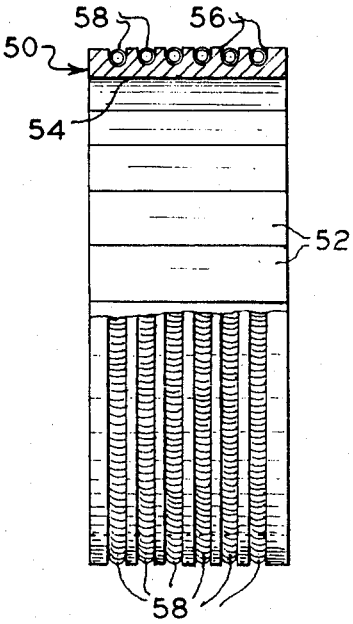
Fig. 4.

APPARATUS FOR FORMING A DOMED BOTTOM IN A CAN BODY

CROSS-REFERENCE TO RELATED APPLICATION

This is a continuation-in-part of the original patent application of Arthur E. Williams, S.N. No. 823,553, filed Jan. 29, 1986, for "APPARATUS FOR FORMING A DOMED BOTTOM IN A CAN BODY" now abandoned.

BACKGROUND OF THE INVENTION

This invention relates to an apparatus for forming domed bottoms in metallic one-piece can bodies which may, for example, be used as beer or beverage containers, and more particularly, to a floating apparatus for forming domed bottoms in one-piece can bodies which may yield radially to a misaligned can body or punch tool.

Many one-piece beer and beverage can bodies are formed with a beveled edge along the periphery of the bottom wall to increase the strength of the wall and thereby permit a minimum gauge metal to be used and thereby reduce the cost of the metal feed stock. There is, however, a tendency for the beveled edge to wrinkle or deform during the bottom doming step. Therefore doming apparatus frequently includes a pressure ring slidably disposed coaxially of the doming die to yield to the advance of the beveled border of the bottom wall of the can as the can body advances and the dome is formed within the bottom wall of the can body. Examples of apparatus for forming domes in the bottom walls of can bodies having a beveled border and incorporating both a doming die and a surrounding axially movable pressure ring are disclosed in the following U.S. Pat. Nos:

3,771,345 —Paramonoff—Nov. 13, 1973
4,289,014 —Maeder et.al—Sep. 15, 1981
4,372,143 —Elert et al—Feb. 8, 1983

None of the above patents disclose doming dies or pressure rings which can radially float, much less such doming apparatus for accommodating misaligned tools or can bodies.

The Maeder U.S. Pat. No. 4,179,909 issued Dec. 25, 1979, discloses a domer assembly for forming domes in one-piece can bodies in which a doming die is mounted to float relative to the housing. However, this Maeder patent does not include a pressure ring axially mounted upon the doming die. Furthermore, the spring members utilized for yielding to radial pressures upon the doming die and for restoring the doming die to its central position after the radial pressure ceases are under constant tension and not provided with any positive abutment means for centrally locating the doming die after the radial pressures have ceased.

The Schaffer U.S. Pat. No. 4,109,502 issued Aug. 29, 1978, and owned by the Assignee of this application, discloses a segmented ring encompassed by a plurality of garter springs to resiliently mount floating ironing and drawing dies for one-piece can making apparatus.

SUMMARY OF THE INVENTION

The apparatus for forming a dome in the bottom wall of a one-piece can body made in accordance with this invention not only incorporates a floating doming die and axially movable pressure ring, but also provides a resilient mechanism which will more accurately restore the doming die and pressure ring to their normal central position without "over-shooting" or "hunting" for the normal central position of the doming apparatus when non-aligning radial forces have ceased, or are non-existent.

The floating doming die and pressure ring incorporated in the dome forming apparatus of this invention permit a more responsive radial yielding of the doming die and pressure ring to misaligning forces without shutting down the operation of the can making apparatus. Such forces may be created by misalignment of the doming die and the ram or punch, or the doming die and can body.

Furthermore, the doming apparatus made in accordance with this invention permits a more rapid restoration of the floating doming die and pressure ring to their original central position when the radial misaligning forces are no longer present.

The apparatus for forming a domed body in a one-piece can body made in accordance with this invention includes a doming die supported within the cavity of a domer housing by mounting means which permits limited radial movement of the doming die as well as the pressure ring axially slidable upon and surrounding the doming die. Surrounding the outer portion of the pressure ring is a segmented ring resiliently urged radially inward by a plurality of circumferentially extending coil springs to urge the pressure ring to its central, normally operating, position. The inward movement of the segments of the segmented ring are restrained to a pure circular central position coaxial of the longitudinal axis of the domer housing by a pair of longitudinally spaced abutment members or plates engaging the front and rear end portions of the inner surfaces of the segmented ring. Preferably, the rear abutment plate is fixedly secured to the rear wall of the domer cavity by fasteners, such as bolts, which also extend through oversized bolt holes or slots in the mounting base or flange of the doming die to permit free radial movement of the doming die relative to the domer housing. The mounting base is also provided with oversized holes through which extend the axially moveable plungers of the air springs. Thus, the doming die is permitted limited radial movement relative to the plungers, as well as to the domer housing.

Since the spring-bound segmented ring is limited in its radial inward movement to the abutment members, the doming die and pressure ring will always be immediately restored to its central position without any overtravel or "hunting" because the inner surfaces of the segmented ring are limited in their radial movement by the abutment members. Moreover, only those segments which are urged radially outward when engaged by the radially outwardly moving portion of the pressure ring, will be moved, since the segments of the segmented ring on the opposite side of the pressure ring will remain in their original position engaging the abutment members.

BRIEF DESCRIPTION OF THE DRAWINGS

FIG. 1 is a fragmentary, sectional elevation of a doming apparatus made in accordance with this invention, with the doming die and pressure ring being located in their central coaxial position;

FIG. 2 is a fragmentary sectional elevation of the doming apparatus disclosed in FIG. 1, with the doming die and pressure ring radially misaligned from the longitudinal axis of the domer housing by engagement with a misaligned punch and can body, shown fragmentarily;

FIG. 3 is a front elevational view of the doming die, pressure ring, and segmented ring, with portions broken away, removed from the domer housing; and FIG. 4 is a side elevational view of the segmented ring, with a portion broken away for clarity.

DESCRIPTION OF THE PREFERRED EMBODIMENT

Referring now to the drawings in more detail, FIG. 1 discloses a doming apparatus 10 generally including many of the structural features of the apparatus disclosed in the U.S. Elert Pat. No. 4,372,143, the portions in the Elert patent, not disclosed, being incorporated by reference. The apparatus 10 discloses the structure of the Elert doming apparatus modified to incorporate the floating doming die and pressure ring of this invention.

The apparatus 10 includes a domer housing 12 which is mounted for axial movement upon a fixed housing, not shown, by a rear air spring, also not shown, but clearly disclosed in the Elert U.S. Pat. No. 4,372,143. Mounted within the domer housing 12 is a domer cavity or chamber 14 separated by a transverse wall 16 from the front air spring chamber 13. The domer cavity 14 is open in front and closed at its rear end by the transverse wall 16 and the circumferential side wall 15 of the chamber 14.

Mounted within the cavity 14 is a doming die 20 having a peripheral or cylindrical side surface 22 and an outer convex front surface 24 designed to engage the bottom wall of a can body 70 (FIG. 2) supported on an advancing ram or punch 72, to form a dome in the bottom wall of the can body 70. The rear end of the doming die 20 forms a diametrically enlarged mounting base or flange 17 having an outer peripheral surface 19.

Mounted in the rear of the cavity 14 between the rear transverse wall 16 and the mounting flange 17 is a spacer plate or disc 21 having an outer circumferential cylindrical surface 23.

The mounting flange 17 and the spacer plate 21 are secured to the transverse back wall 16 by a plurality of circumferentially spaced fastener members, such as the threaded bolts 18. However, the bolt holes 25 formed through the base flange 17 are radially oversized, or diametrically larger than the diameters of the corresponding portions of each bolt 18. Thus, although the doming die 20 is held against axial movement by the bolts 18 relative to the domer housing 12, nevertheless limited radial movement is permitted between the domer die 20 and the housing 12, as well as the spacer plate or disc 21.

Also circumferentially spaced concentrically of the domer housing 12 are a plurality of elongated lined plunger holes 26 for slidably and axially receiving corresponding plungers 28. The plungers 28 bear against the plunger plate 27, which forms the front end of a second air spring, not shown, but clearly disclosed in the prior Elert U.S. Pat. No. 4,372,143. The plungers 28 also extend through corresponding holes 29 in the spacer plate 21 and through oversized holes 31 in the mounting flange 17. Each oversized hole 31 has the same radial spacing from its corresponding plunger 28 as each oversized hole 25 has from its corresponding bolt 18, to permit the mounting flange 17, and thus the doming die 20, limited radial movement relative to the cavity 14.

Also mounted within the cavity 14 concentrically and surrounding the doming die 20 is the pressure ring 30 having an inner cylindrical surface 32 in axial, slidable engagement with the peripheral side surface 22 of the doming die 20. The pressure ring 30 includes a substantially planar transverse or rear surface 34 in engagement with the front ends of the plungers 28. A beveled front surface 36 on the pressure ring 30 is adapted to engage the corresponding beveled edge of the can body 70, for transmitting the reactive forces of the apparatus 10 to the can body 70 when the convex surface 24 of the doming die 20 forms the dome in the bottom wall of the can body.

The pressure ring 30 has a radially outwardly directed flange 38 having an outer peripheral cylindrical surface 39. The outer peripheral surface 39 is preferably in axial slidable engagement with the inner surface 40 of an annular wear ring 42. The inner surface 40 of the wear ring 42 is in bearing engagement with not only the outer peripheral surface 39 of the pressure ring flange 38, but also the outer peripheral surface 19 of the mounting flange 17. The outer peripheral surface 43 of the wear ring 42 is in bearing engagement with the inner peripheral surface 54 of a segmented ring 50.

As illustrated in FIGS. 2 and 4, the segmented ring 50 is split into a plurality of preferably identical arcuate segments 52, abutting end-to-end, normally to form the purely circular segmented ring 50. Formed in the outer surface of the segmented ring 50 are a plurality of axially spaced, circumferential grooves 56. The corresponding grooves 56 in each of the segments 52 are circumferentially aligned to receive a resilient means, such as a continuous coil spring or garter spring 58 in each set of aligned grooves 56. Thus, the springs 58 urge the segments 52 radially inward and hold the segments 52 in end-to-end abutting relationship. The segmented ring 50 is essentially the same as that disclosed in the prior Schaffer U.S. Pat. No. 4,109,502.

In order to cover the open front end of the domer cavity 14, a disc-like cover plate 60 is fitted over the front end of the housing 12 and secured concentrically to the housing 12 by the bolts 64. The cover plate 60 is provided with a central circular opening 61 having a slightly larger diameter than the outer diameter of the wedge-shaped front portion 35 so that the pressure ring 30 and the domer die 20 are free to project through the cover plate opening 61.

The rear portion of the cover plate 60 adjacent the opening 61 projects rearwardly to form an annular flange 62 to define an annular, preferably cylindrical, axial abutment surface 63 for engaging and supporting the front end portion of the segmented ring 50. The rear end portion of the segmented ring 50 engages and is supported upon the peripheral abutment surface 23 of the spacer plate 21.

The diameter of the peripheral surface 23 is equal and coaxial to the diameter of the abutment surface 63.

The abutment surfaces 23 and 63, the outer peripheral surface 15 of the domer chamber 14, the outer annular rear wall surface 65 of the cavity 14 and the rear annular wall surface 66 of the cover plate 60 define a segmented ring chamber 68 for receiving and confining the segmented ring 50. The radial extent of the segmented chamber 68, that is the distance between the abutment surfaces 23 and 63 and the outer peripheral wall surface 15 is slightly greater than the thickness of the segmented ring 50, to permit limited outward radial movement of the segmented ring 50 from its normal centered position engaging the abutment surfaces 23 and 63.

The axial length of the wear ring 42 is less than the axial length of the segmented ring 50 and slightly less than the axial distance between the spacer plate 21 and the cover plate flange 62. The axial length of the pressure ring base flange 38 is substantially less than the distance between the front surface of the domer mounting flange 17 and the rear surface of the cover plate abutment flange 62 to permit limited axial movement of the pressure ring 30 against the reactive force of the plungers 28.

Preferably at least 5 segments are incorporated in the segmented ring 50.

Moreover, in the preferred form of the invention, a plurality of (for example, five) bolts 18 are normally spaced equally circumferentially around the mounting flange 17 and radially equidistant from the axis of the domer cavity 14. Furthermore, a plurality of (for example, five) plungers 28 are preferably utilized, also spaced equally circumferentially around the mounting flange 17 and radially equidistant from the axis of the cavity 14.

When the doming die 20 and the pressure ring 30 are in their normal central position, that is coaxial of the domer cavity 14, the wear ring 42 and the segmented ring 50 are also coaxial of the cavity 14.

Since the total diametric travel of the doming die 20 and the pressure ring 30 relative to the housing 12 or cavity 14 is usually approximately 0.060–0.080 inches to accommodate any misalignment between the doming die 20, the pressure ring 30 and the punch 72 of the can making apparatus, as well as for any misalignment of the can body 70, the radial clearance between the side surface of each bolt 18 and its corresponding side surface of its oversized slot 25 is approximately 0.045 inches in order to overcompensate for the radial travel of the doming die 20. This same radial clearence also exists between the side surface of each of the plungers 28 and its opposed side surface of the oversized slot or hole 31 in the mounting flange 17. The same radial clearance (0.045 inches) exists between the outer surface of the front pressure ring flange 35 and the inner cylindrical surface of the cover plate opening 61. On the other hand, the maximum radial clearance between the outer surface of the segmented ring 50 and the outer cavity wall 15 is preferably approximately 0.040 inches. In the operation of the apparatus 10, before the doming operation commences upon the can body 70 (FIG. 2), all of the radially movable parts are in their central coaxial positions of substantially equal clearance around the bolts 18, plungers 28, the front projecting portion 35 of the pressure ring 30, and the segmental ring 50, as disclosed in FIG. 1. When a can body 70 is forced against the pressure ring 30 and the doming die 20, and either the can body 70 or the punch 72 is eccentric to the normal axis of the housing cavity 14, the pressure ring 30 and doming die 20 are urged radially in the same direction as the eccentricity of the can body 70. As illustrated in FIG. 2, the can body 70 has been radially misaligned upward of its normal coaxial position. When the misaligned can body 70 and punch 72 engage the pressure ring 30 and the doming die 20, the doming die 20 and the pressure ring 30 are forced radially upward (FIG. 2). However, even if the upper portion of the segmented ring 50 travels to its full diametrical extent (e.g. 0.080 inches) and engages the upper wall surface 15 of the cavity 14, as shown in FIG. 2, there is still clearance between the oversized bolt hole 25 in the lower portion of the housing 12 and its corresponding bolt 18, because of the greater diameter (e.g. 0.090 inches) of the bolt hole 25. Likewise, the same clearance exists between the upper oversized plunger hole 31 and the bottom of its corresponding plunger 28, as well as between the upper surface of the front pressure ring flange 35 and the upper portion of the cover opening 61. Corresponding clearance adjustments are simultaneously made between the other four bolts 18, not shown, and their corresponding oversized slots 25, as well as the other four plungers 28 and their corresponding oversized slots 25. As illustrated in FIG. 2, the bottom portion of the outer surface of the front pressure ring portion 35 is spaced a corresponding clearance distance from the opposing portion of the cover plate opening 61. Although FIG. 2 appears to disclose the bolt 18 touching the bolt hole 25, the plunger 28 touching the plunger hole 31, and the front pressure ring flange 35 touching the cover opening 61, in fact there is a small clearance between these parts, as described above, when the segmented ring 50 engages the cavity wall 15, to prevent undue wear between such parts, and even shearing of the bolts 18.

However, only those segments 52 of the segmented ring 50 are urged radially outward, which are engaged by the outer surface 43 of the wear ring 42 which extends radially outward beyond the abutment surfaces 23 and 63. As illustrated in FIG. 2, the upper segments 52 have been urged to their outer limits against the wall surface 15, while the lower segments 52 of the segmented ring 50, as illustrated in FIG. 2 remain in their original position abutting the corresponding portions of the abutment surfaces 23 and 63. In the expanded position of the segmented ring 50, the coil springs 58 are placed under greater tension than they were when the segmented ring 50 was in its original central position.

After misalignment of the can body 70 and ram 72 relative to the doming die 20 and pressure ring 30 has ceased, and the doming die 20 and pressure ring 30 are no longer under eccentric pressure, the coil springs 58 immediately urge the outwardly extended segments 20 radially inward to their fully circular normal central position where the segments 52 again abut their corresponding abutment surfaces 23 and 63. Accordingly, the segmented ring 50, the wear ring 42, the pressure ring 30 and the doming die 20 are fully restored to their original central position coaxial with the domer cavity 14, and no further, without any overtravel, oscillation or "hunting" for their central position.

It will be noted that during the restoring process, those segments, such as the lower segments 52 in FIG. 2, which are not extended and remain in engagement with their corresponding abutment surfaces 23 and 63, never move, and therefore always remain in their original central position.

Furthermore, since only those arcuate segments 52 which are engaged by the outer projecting wear ring 42 during misalignment are radially extended, only those segments are involved in the restoring movement. Consequently, only the inertia of the radially moved segments 52, rather than the inertia of the entire segmented ring 50, are involved in the restoring movement, making the resilient means more sensitive to react quickly to restore the doming die and pressure ring to their original central position when the eccentric or misaligning forces have been removed.

The apparatus 10 will operate successfully if the wear ring 42 is removed and the pressure ring flange 38 is radially extended outward to normally engage the inner surface 43 of the segmented ring 50. However, longer life of the parts may be obtained by utilizing the wear ring 42 as illustrated. For purposes of the claims of this invention, the wear ring 42 may be considered as an outer portion or surface member of the pressure ring 30, and specifically, the outer portion or surface member of the pressure ring flange 38.

The doming apparatus 10 incorporating the floating doming die 20 and pressure ring 30 of this invention was tested by deliberately misaligning the domer apparatus by 0.025 inches. The doming apparatus moved back into perfect alignment and continued to remain in alignment throughout the test operation. The apparatus was tested on a one-piece metal can production line for a three-month period, with an increase in on-line hours of operation, increased productivity and less wear on the tooling.

What is claimed is:

1. Apparatus for forming an inwardly extending dome in the bottom wall of a metallic one-piece can body having a beveled peripheral edge bordering the bottom wall comprising:

(a) a domer housing comprising a cavity having a longitudinal front-to-rear axis and a front end opening, (b) a doming die within said cavity having a longitudinal front-to-rear axis, a peripheral side surface, and a front outer convex surface for engaging the bottom wall of a can body to form a dome therein, (c) a pressure ring supported coaxially around said peripheral side surface for axial movement relative to said doming die, said pressure ring having a circumferential outer surface member and a front annular beveled surface adapted to engage the beveled peripheral edge bordering the bottom wall of a can body while said doming die is forming a dome in said bottom wall, (d) pressure-absorbing plunger means within said domer housing for engaging and moving axially with said pressure ring, (e) securing means supporting said doming die normally coaxially within said cavity for limited radial movement of said doming die and said pressure ring relative to said domer housing and said plunger means, (f) a segmented ring having a plurality of circumferentially arranged segments within said housing surrounding said pressure ring and having an inner surface normally in bearing engagement with said outer surface member, (g) abutment means in said cavity adapted to engage said inner surface of said segmented ring to limit the radial movement of said segmented ring to a normal central position coaxial of said cavity, (h) said pressure ring being radially movable relative to said abutment means, whereby in a radially extended position an extended portion of said outer surface member projecting radially outward beyond said abutment means moves radially outward segments of said segmented ring engaged by said extended portion, and (i) spring means surrounding said segmented ring to bias said inner surfaces of said segments toward said abutment means to urge said pressure ring and said doming die to said normal central coaxial position.

2. The invention according to claim 1 in which said abutment means comprises front and rear circumferential abutment members fixed in said cavity to said domer housing and longitudinally spaced a pre-determined distance, said segmented ring having an axial length greater than the spacing between said abutment members, the rear portion of said inner surface of said segmented ring normally engaging said rear abutment member and the front portion of said inner surface of said segmented ring normally engaging said front abutment member, said circumferential outer surface member being located between said abutment members.

3. The invention according to claim 2 in which said front abutment member comprises a cover plate having a central opening therethrough for receiving the front end portions of said pressure ring and said doming die, and means for detachably securing said cover plate to the front of said domer housing.

4. The invention according to claim 2 in which said doming die comprises an enlarged rear mounting flange, said domer housing cavity having a rear cavity wall, said rear abutment member being located between said mounting flange and said rear cavity wall, said fastener means securing said mounting flange to said rear abutment member and said rear cavity wall.

5. The invention according to claim 4 in which said fastener means comprises a plurality of bolts extending through said mounting flange, said rear abutment member and said rear cavity wall, an oversized bolt hole through said mounting flange for each of said bolts to permit limited radial movement of said doming die relative to said rear abutment member.

6. The invention according to claim 5 in which said plunger means comprises at least one elongated plunger and a coaxial hole through said rear cavity wall, said rear abutment member and said mounting flange for receiving each of said plungers for axial movement, and an oversized hole in said mounting flange surrounding each said plunger to permit limited radial movement of said doming die relative to each said plunger.

7. The invention according to claim 2 in which said housing and said abutment members form an annular segmented ring cavity for receiving said segmented ring, said segmented ring cavity having an outer circumferential wall spaced from the periphery of said abutment members a radial distance greater than the radial thickness of said segmented ring to provide clearance for limited radial movement of at least some of the segments of said segmented ring.

8. The invention according to claim 1 in which said circumferential outer surface member of said pressure ring comprises a wear ring having an outer bearing surface normally engaging said inner surface of said segmented ring, and a cylindrical outer surface on said pressure ring, said wear ring having an inner surface slidably engaging said cylindrical outer surface to permit relative axial movement between said pressure ring and said wear ring.

9. The invention according to claim 8 in which said doming die comprises a rear mounting flange, said mounting flange comprising a cylindrical outer surface having the same diameter as, and being coaxial with, said cylindrical outer surface of said pressure ring, said inner surface of said wear ring surrounding and bearing upon both cylindrical outer surfaces of said mounting flange and said pressure ring.

* * * * *